United States Patent [19]

Sayles

[11] Patent Number: 4,707,199

[45] Date of Patent: Nov. 17, 1987

[54] NON NITROGLYCERIN-CONTAINING COMPOSITE-MODIFIED DOUBLE-BASE PROPELLANT

[75] Inventor: David C. Sayles, Huntsville, Ala.

[73] Assignee: The United States of America as represented by the Secretary of the Army, Washington, D.C.

[21] Appl. No.: 543,397

[22] Filed: Oct. 17, 1983

[51] Int. Cl.[4] ..... C06B 45/10

[52] U.S. Cl. ..... 149/19.2; 149/19.4; 149/19.6; 149/19.8; 149/20

[58] Field of Search ..... 149/19.2, 19.4, 19.6, 149/19.8, 20

[56] References Cited

U.S. PATENT DOCUMENTS

| | | | |
|---|---|---|---|
| 4,269,637 | 5/1981 | Flanagan | 149/19.4 |
| 4,288,262 | 9/1981 | Flanagan et al. | 149/19.6 |
| 4,379,894 | 4/1983 | Frankel et al. | 525/403 |
| 4,379,903 | 4/1983 | Reed, Jr. et al. | 149/19.92 |

*Primary Examiner*—Edward A. Miller

*Attorney, Agent, or Firm*—John H. Raubitschek; Werten F. W. Bellamy; Freddie M. Bush

[57] ABSTRACT

The glycidyl azide polymer produced by hydrolysis of glycidyl chloride followed by reaction with sodium azide is employed in a crosslinked composite-modified double-base propellant composition both in the casting powder portion and casting solvent portion as a superior replacement for nitroglycerin in each portion specified. The crosslinked composite-modified double-base propellant composition is characterized by having a greater safety in handling, reduced sensitivity to detonation, higher burning rate, higher specific impulse, and improved mechanical properties as compared with a like composition containing nitroglycerin in the casting powder and the casting solvent portions.

1 Claim, No Drawings

NON NITROGLYCERIN-CONTAINING COMPOSITE-MODIFIED DOUBLE-BASE PROPELLANT

DEDICATORY CLAUSE

The invention described herein may be manufactured, used, and licensed by or for the Government for governmental purposes without the payment to me of any royalties thereon.

BACKGROUND OF THE INVENTION

Solid propellant compositions have employed nitroglycerin as an explosive plasticizer which is a highly energetic plasticizer. Although much success has been achieved with the use of nitroglycerin or its related derivatives in solid propellant compositions, a greater degree of safety in handling and a reduced sensitivity to detonation have been desired. A replacement for nitroglycerin in solid propellants which yields the improved safety advantages would be of particular interest in either crosslinked or uncrosslinked composite-modified double-base propellants. Even of further particular interest would be such a replacement for nitroglycerin which results in a higher burning rate, a higher specific impulse, and improved mechanical properties of the propellant composition.

The handling sensitivity of nitroglycerin has always been a matter of extreme concern, and especially, more recently of the detonation which occurred in a nitroglycerin processing facility which resulted in the loss of several lives.

An object of this invention is to provide a replacement for nitroglycerin in crosslinked or uncrosslinked composite-modified double-base propellants.

A further object of this invention is to provide a replacement for nitroglycerin in crosslinked or uncrosslinked composite-modified double-base propellants which results in a propellant composition having a greater safety in handling, reduced sensitivity to detonation, higher burning rate, higher specific impulse, and improved mechanical properties.

SUMMARY OF THE INVENTION

The glycidyl azide polymer produced by hydrolysis of glycidyl chloride followed by reaction with sodium azide is a superior replacement for nitroglycerin of the casting powder portion of an ultrahigh-burning rate propellant for application in an interceptor system, such as the Endoatmospheric Nonnuclear Kill interceptor system. The above described propellant is comprised of a casting powder portion which comprises about 71.7 weight percent of the propellant composition and a casting solvent portion which comprises about 28.3 weight percent of the propellant composition. An equivalent molar weight percent of glycidyl azide polymer formed from hydrolysis of glycidyl chloride followed by reaction with sodium azide is substituted for the nitroglycerin of the casting powder portion. The casting powder portion of the propellant composition is comprised in parts by weight of ingredients whose functions, ingredients, and amounts are set forth as follows:

| Function | Ingredient | Parts by Weight |
|---|---|---|
| binder | nitrocellulose (12.5% nitrogen) | 16.6 |
| catalyst | carboranylmethyl propionate | 4.7 |
| curative | triacetin | 17.5 |
| stabilizer | 2-nitrodiphenylamine | 1.1 |
| stabilizer | resorcinol | 0.7 |
| oxidizer | ammonium perchlorate (1 μm) | 32.8 |
| metal fuel | aluminum (20 μm) | 7.2 |
| fuel and mechanical burning rate accelerator | aluminum whiskers | 2.9 |
| energetic binder | glycidyl azide polymer | 16.0 |

The casting solvent portion is comprised of glycidyl azide 45.8 parts, triacetin 52.7 parts, triphenylbismuthine 0.07 part, and hexane diisocyanate 0.50 part.

DESCRIPTION OF THE PREFERRED EMBODIMENT

A glycidyl azide polymer is a superior replacement to nitroglycerin in either crosslinked or uncrosslinked composite-modified double-base propellants. The glycidyl azide polymer of specific reference is produced by hydrolysis of glycidyl chloride followed by reaction with sodium azide, as illustratd in the reaction titled: "Synthesis of Glycidyl Azide Polymer", set forth below.

SYNTHESIS OF GLYCIDYL AZIDE POLYMER

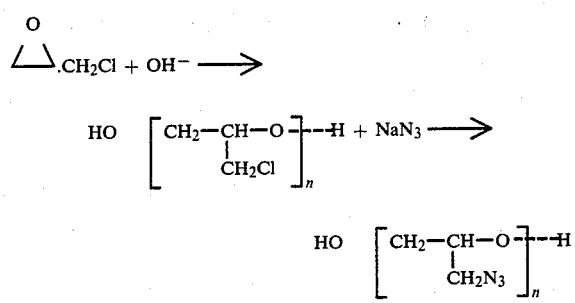

Table I provides a data sheet on glycidyl azide polymer (GAP)

TABLE 1

| Glycidyl Azide Polymer (GAP) | |
|---|---|
| Chemical Structural Formula: | HO [CH2—CH(CH2Cl)—O]n—H, wherein n is from about 17 to about 26. |
| Molecular Weight: | 2000–3000 |
| Functionality: | 2.0–3.0 |
| Density: | 1.30 g/cc |
| Glass Transition Temperature: | −20° C. |
| Impact Sensitivity: | 173 in-lb |
| Thermal Stability: | 0.1 ml $N_2$ after 600 hrs at 60° C. |
| Heat of Formation: | +33 Kcal/mole (Experimental) |
| Burn Rate: | 0.77 in/sec at 1000 psi (Self Extinguishes at Ambient Pressure) |

Table 2, below, sets forth a preferred embodiment of the experimental composition B containing GAP. The properties of an endoatmospheric nonnuclear kill propellant and the improvement achieved with the use of GAP as a replacement for the nitroglycerin in an equivalent molar weight percent are compared with composition A, the nitroglycerin propellant, in Table 2.

TABLE 2

Composition and Properties of a typical Endoatmospheric Nonnuclear Kill Candidate Propellant

| INGREDIENT | PROPELLANT COMPOSITION A (Parts by Wt.) Propellant Based on Nitroglycerin | B (Parts by Wt.) Propellant Based on Glycidyl Azide |
|---|---|---|
| CASTING POWDER | | |
| Nitrocellulose (12.5% N) | 16.6 | 16.6 |
| Nitroglycerin | 31.1 | 0.0 |
| Carboranylmethyl propionate | 4.7 | 4.7 |
| Triacetin | 2.5 | 17.5 |
| 2-Nitrodiphenylamine | 1.1 | 1.1 |
| Resorcinol | 0.7 | 0.7 |
| Ammonium perchlorate (1 μm) | 32.8 | 32.8 |
| Aluminum (20 μm) | 7.2 | 7.2 |
| Aluminum whiskers | 2.9 | 2.9 |
| Glycidyl azide | 0.0 | 16.0 |
| CASTING SOLVENT | | |
| Glycidyl azide | 0.0 | 45.8 |
| Nitroglycerin | 89.5 | 0.0 |
| Triacetin | 8.95 | 52.7 |
| Hexane Diisocyanate | 0.50 | 0.50 |
| Triphenylbismuthine (catalyst for reaction resulting in urethane formation) | 0.07 | 0.07 |
| RATIO OF CASTING POWDER TO CASTING SOLVENT | 72/28 | 72/28 |
| MECHANICAL PROPERTIES (77° F.) (0.74-in-min$^{-1}$) | | |
| Tensile Strength | 365 psi | 440 |
| Strain at Maximum Stress | 54% | 60% |
| Modulus | 1,050 | 1,200 |
| CURE TIME AT 145° F. | 3 to 4 days | 3 to 4 days |
| EXPLOSIVE SENSITIVITY | | |
| Impact Test (Kg/cm) | 200 | 300 |
| Explosive Classification | 1.1 | 1.3 (expected) |
| DOT | Class A | Class B |
| Uncured strand burning rate | — | 7.4 |
| 10-lb CHARGE MOTOR FIRINGS | | |
| Burning Rate (at 2,000 psi) | 6.7 | 10.2 |
| Pressure Exponent (500–3,000 psi) | 0.68 | 0.55 |
| Ispd (Delivered Specific Impulse) | | |
| (lbf-s/lbm) | 251.6 | 255.1 |
| (KN-s/kg) | 2.467 | 2.501 |
| End-of-mix viscosity (kP) | 10.5 | 14.1 |

The incorporation of GAP into the propellant composition results in a greater safety in handling, reduced sensitivity to detonation, higher burning rate, higher specific impulse, and improved mechanical properties.

I claim:

1. A crosslinked composite-modified double-base propellant composition comprising a casting powder portion and a casting solvent portion, said casting powder portion comprising about 72.0 weight percent of said propellant composition and said casting solvent portion comprising about 28.0 weight percent of said propellant composition, said casting powder portion comprised in part by weight of ingredients as follows:

| | |
|---|---|
| nitrocellulose (12.5% nitrogen) | 16.6 |
| carboranylmethyl propionate | 4.7 |
| triacetin | 17.5 |
| 2-nitrodiphenylamine | 1.1 |
| resorcinol | 0.7 |

-continued

| | |
|---|---|
| ammonium perchlorate (1 μm) | 32.8 |
| aluminum (20 μm) | 7.2 |
| aluminum staple (whiskers) | 2.7 |
| glycidyl azide polymer formed from hydrolysis of glycidyl chloride followed by reaction with sodium azide | 16.0 |

, and said casting solvent portion comprised in parts by weight of ingredients as follows:

| | |
|---|---|
| glycidyl azide | 45.8 |
| triacetin | 52.7 |
| hexane diisocyanate | 0.50 |
| triphenylbismuthine | 0.07 |

, said crosslinked composite-modified double-base propellant composition characterized by having greater safety in handling, reduced sensitivity to detonation, higher burning rate, higher specific impulse, and improved mechanical properties as compared with a like composition containing nitroglycerin in said casting powder portion and in said casting solvent portion in equivalent molar weight amounts to said glycidyl azide polymer.

* * * * *